US006036826A

United States Patent [19]

Kawachi et al.

[11] Patent Number: 6,036,826

[45] **Date of Patent: *Mar. 14, 2000**

[54] TITANIUM ELECTRODEPOSITION DRUM

[75] Inventors: Katsuya Kawachi; Mitsuo Kihara, both of Joetsu, Japan

[73] Assignee: Nitto Stainless Steel Kozai Co., Ltd., Niigata-Ken, Japan

[ * ] Notice: This patent is subject to a terminal disclaimer.

[21] Appl. No.: 09/037,081

[22] Filed: Mar. 9, 1998

[51] Int. Cl.[7] ..... C25D 17/00

[52] U.S. Cl. ..... 204/213; 204/290 R; 204/272; 204/290 F

[58] Field of Search ..... 204/213, 290 R, 204/272, 208, 290 F; 205/240, 292

[56] References Cited

U.S. PATENT DOCUMENTS 5,888,358 3/1999 Kihara et al. ..... 204/213

*Primary Examiner*—Bruce F. Bell

*Attorney, Agent, or Firm*—Sughrue, Mion, Zinn, Macpeak & Seas, PLLC

[57] ABSTRACT

A titanium electrodeposition drum "a" n which a titanium plate 2 is positioned over an outer circumferetial surface 1*a* of an outer circumferential plate 1 of an inner drum b, with a circumferential copper system plate 3*a* such as a copper plate or a copper alloy plate, interposed between and intimately contacting the outer circumferential surface 1*a* of the outer circumferential plate 1 of the inner drum b and an inner circumferential surface 2*a* of the titanium plate 2.

14 Claims, 5 Drawing Sheets

TITANIUM ELECTRODEPOSITION DRUM

BACKGROUND OF THE INVENTION

The present invention relates to an titaniumi electrodeposition drum in a copper foil manufacturing machine for producing a copper foil.

Electrodeposition drums for electrolytically deposing a copper foil having a uniform and smooth surface at a constant thickness are known. Currently, in many cases, a titanium plate that is superior in corrosion-resistance against electrolyte liquid is attached on a surface of an inner drum and a copper foil having a uniform and smooth surface and a constant thickness is formed on an outer circumferential surface of titanium plate.

In general, the titanium plate is attached on an outer circumferential portion of the inner drum, which is formed of soft steel or stainless steel, and an electric application is effected through the outer circumferential portion.

SUMMARY OF THE PRESENT INVENTION

The present inventors have studied the possibility that, if conductivity on the inner drum side is good, it is unnecessary to improve the conductivity of the titanium plate, and if contactability between the titanium plate and the inner drum is kept well, a desired constant thickness copper foil having a uniform and smooth surface may be formed. A titanium electrodeposition drum in which an inner side of a titanium plate was lined with a copper plate or the like was produced for tests by the present inventors. Furthermore, in order to obtain an effective electrodeposition effect by further increasing an electric supply, a copper plate or the like was additionally provided on right and left side walls or an intermediate reinforcement plate of the inner drum. Such electrodeposition drums were made and the tests were repeated to reduce the present invention to practice.

According to a first aspect of the invention, there is provided a titanium electrodeposition drum in which a titanium plate is provided on an outer circumferential surface of an outer circumferential plate of an inner drum, characterized in that a circumferential copper system plate such as a copper plate or a copper alloy plate is interposed between an outer circumferential surface of the outer circumferential plate of the inner drum and an inner circumferential surface of a titanium plate under an intimate contact condition on each of said upper and lower surfaces of the circumferential copper system plate.

Also, in the titanium electrodeposition drum according to a first aspect of the invention, side copper system plates such as copper plates or copper alloy plates are provided on outer surfaces of right and left side wall plates of the inner drum, and the side copper plates and the circumferential copper system plate are provided close to or integrally with each other under a conductive condition.

Also, in the titanium electrodeposition drum according to the first and second aspects of the invention, an intermediate copper system plate such as a copper plate or a copper alloy plate is provided on an intermediate reinforcement plate of the inner drum, and the intermediate copper system plate and the circumferential copper system plate are provided close to or integrally with each other in a conductive condition.

A preferred embodiment of the present invention will briefly be described as follows.

According to the first aspect of the invention, linear expansion coefficients of the copper alloy such as copper, brass, titanium and iron are given as follows:

| | |
|---|---|
| titanium | $8.41 \times 10^{-6}$ (20° C.) |
| iron | $11.76 \times 10^{-6}$ (20° C.) |
| copper | $16.5 \times 10^{-6}$ (20° C.) |
| brass | 20 to 21 $\times 10^{-6}$ (20° C.) |

As described above, the copper system plate expands 2 to 2.5 times more than the titanium. Accordingly, the circumferential copper plate 3*a* is adhered to the inner circumferential surface of the titanium plate 2 by the temperature increase during the manufacture. The contactability between the titanium plate 2 and the circumferential copper plate 3*a* is enhanced.

The electric resistances of the four components are as follows:

| | |
|---|---|
| titanium | 55 (20 ° C. $\mu\,\Omega \cdot$ cm) |
| iron | 9.71 (20° C. $\mu\,\Omega \cdot$ cm) |
| copper | 1.67 (20° C. $\mu\,\Omega \cdot$ cm) |
| brass | 3.6 to 3.7 (20° C. $\mu\,\Omega \cdot$ cm) |

As described above, the copper system plate is superior in conductivity, e.g., several tens of times or more than the titanium. Thus, if the circumferential copper system plate 3*a* that is superior in conductivity is lined under an intimate contact condition on the inside of the titanium plate 2 by utilizing its relatively high linear expansion coefficient, it is possible that the insufficiency of the conductivity of the titanium plate 2 would be expected to be compensated.

According to this synergetic effect, foil having the constant thickness and having the uniform and smooth surface over the entire range is produced, and at the same time, it is possible to provide a titanium electrodeposition drum for producing on the surface of the titanium plate foil of superior quality without generation of any local electric resistance heat that causes trouble.

According to the second aspect of the invention, the side copper system plates 3*b* formed on the outer surfaces of the right and left side walls 4 of the inner drum b are provided close to or integrally with the circumferential copper system plate 3*a* formed on the inside of the titanium plate 2 under a conductive condition. The electric supply to the circumferential copper system plate 3*a* by the side copper system plates 3*b* is increased. It is possible to improve the effect of the first aspect in the titanium electrodeposition drum a.

According to the third aspect of the invention, the intermediate copper system plate 3*c* formed on the intermediate reinforcement plate 5 is also provided close to or integrally with the circumferential copper system plate 3*a*. It is possible to provide the titanium electrodeposition drum in a way which will obtain the electric supply to the titanium plate 2 as desired.

DESCRIPTION OF THE PREFERRED EMBODIMENTS

Figure 1:
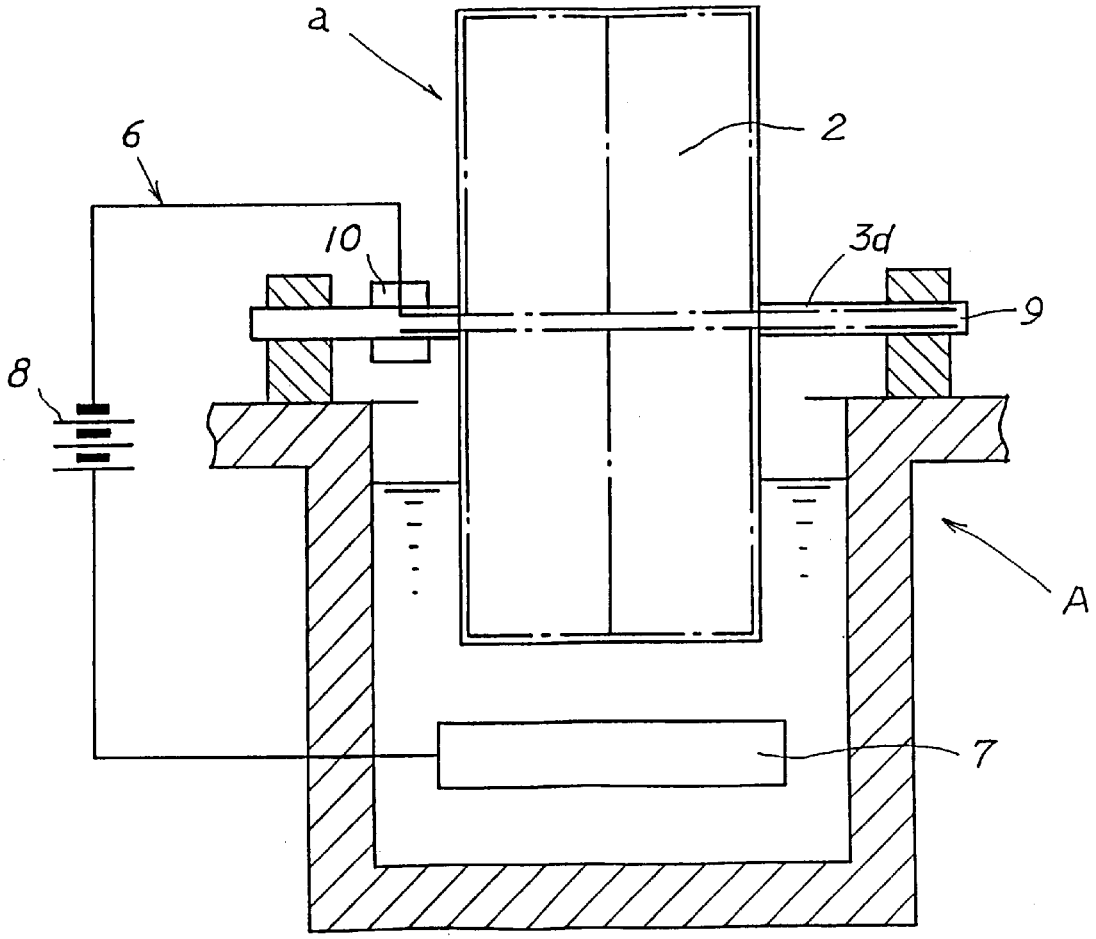
FIG. 1 is an illustration of a copper foil manufacturing machine.

An embodiment of the present invention will now be described with reference to the accompanying drawings.

In a titanium electrodeposition drum a shown in the drawings, a titanium plate 2 is provided on an outer circumferential surface 1*a* of an outer circumferential plate 1 of an inner drum b. A circumferential copper system plate 3*a* such as a copper plate or a copper alloy plate is interposed between the outer circumferential surface 1*a* of the outer circumferential plate 1 of the inner drum b and an inner circumferential surface 2*a* of the titanium plate 2 with its upper and lower surfaces in intimate contact with the outer circumferential surface 1*a* and the inner circumferential surface 2*a*. Side copper plates 3*b* such as copper plates or copper alloy plates are provided on outer surfaces of right and left side wall plates 4 of the inner drum b. The side copper plates 3*b* and the circumferential copper plate 3*a* are provided close to or integrally with each other under a conductive condition. An intermediate copper system plate 3*c* such as a copper plate or a copper alloy plate is provided on an intermediate reinforcement plate 5 of the inner drum b. The intermediate copper system plate 3*c* and the circumferential copper plates 3*a* are provided close to or integrally with each other under a conductive condition.

FIG. 1 is an illustration of a copper manufacturing machine A including a conductive line 6, an electrode 7, a power source 8, a rotary shaft 9, a copper sleeve provided around an outer circumference of the rotary shaft 9 and a conductive bearing 10.

Figure 2:
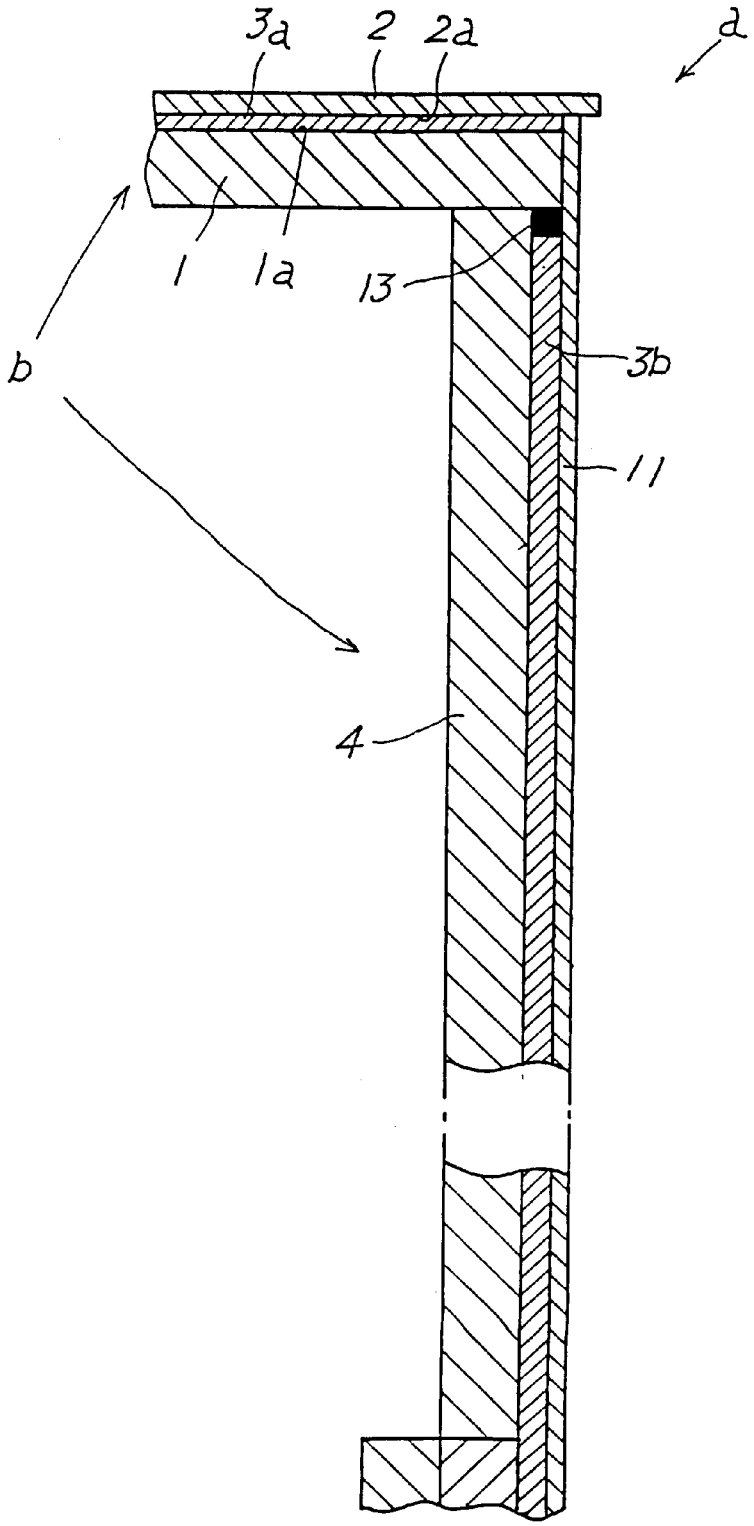
FIG. 2 is a longitudinal sectional view showing a primary part of an embodiment in which side copper system plates are provided close to a circumferential copper system plate.
Figure 3:
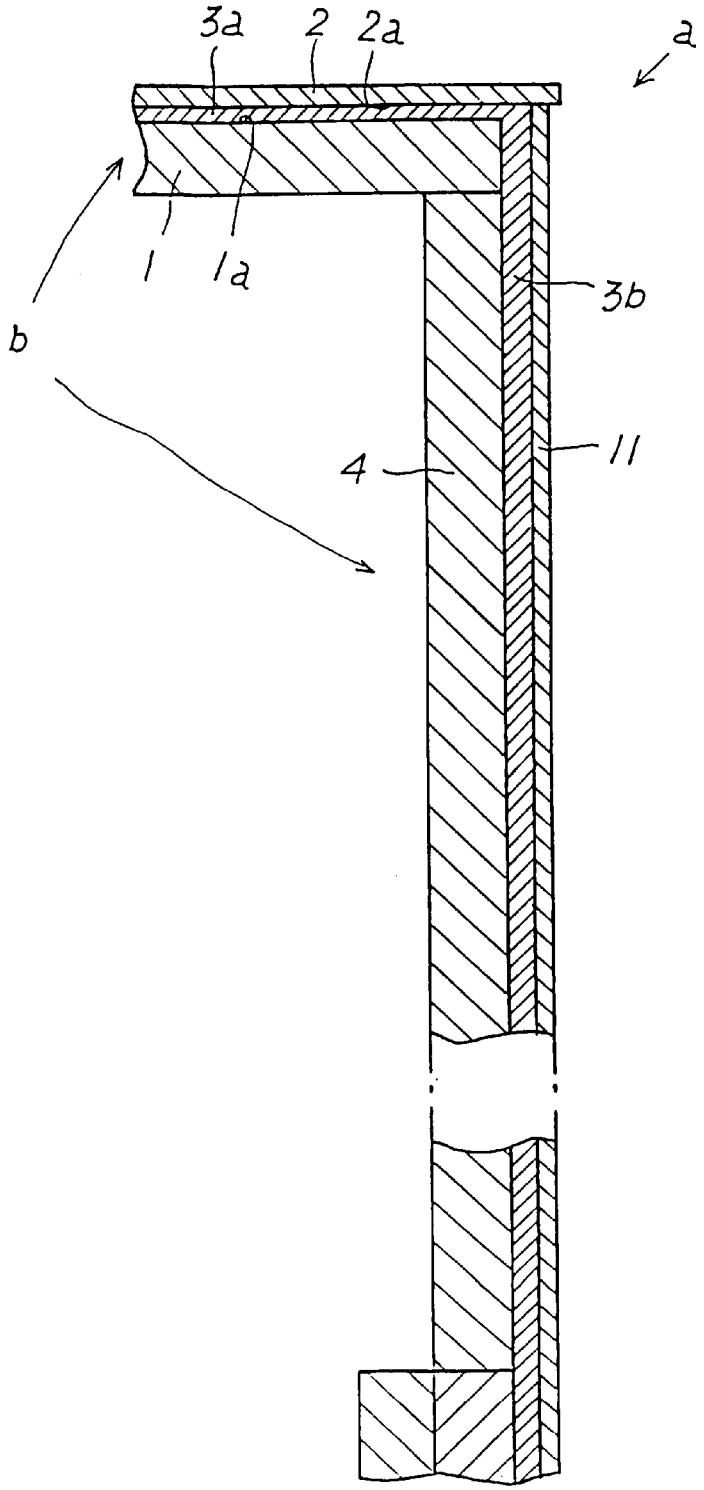
FIG. 3 is a longitudinal sectional view showing a primary part of an embodiment in which side copper system plates are provided integrally with a circumferential copper system plate.

FIG. 2 is a view showing an embodiment in which the side copper plates 3*b* are provided close to the circumferential copper system plate 3*a*. FIG. 3 is a view showing an embodiment in which the side copper plates 3*b* are provided integrally with the circumferential copper system plate 3*a*. Reference numeral 13 denotes a welded portion.

Figure 4:
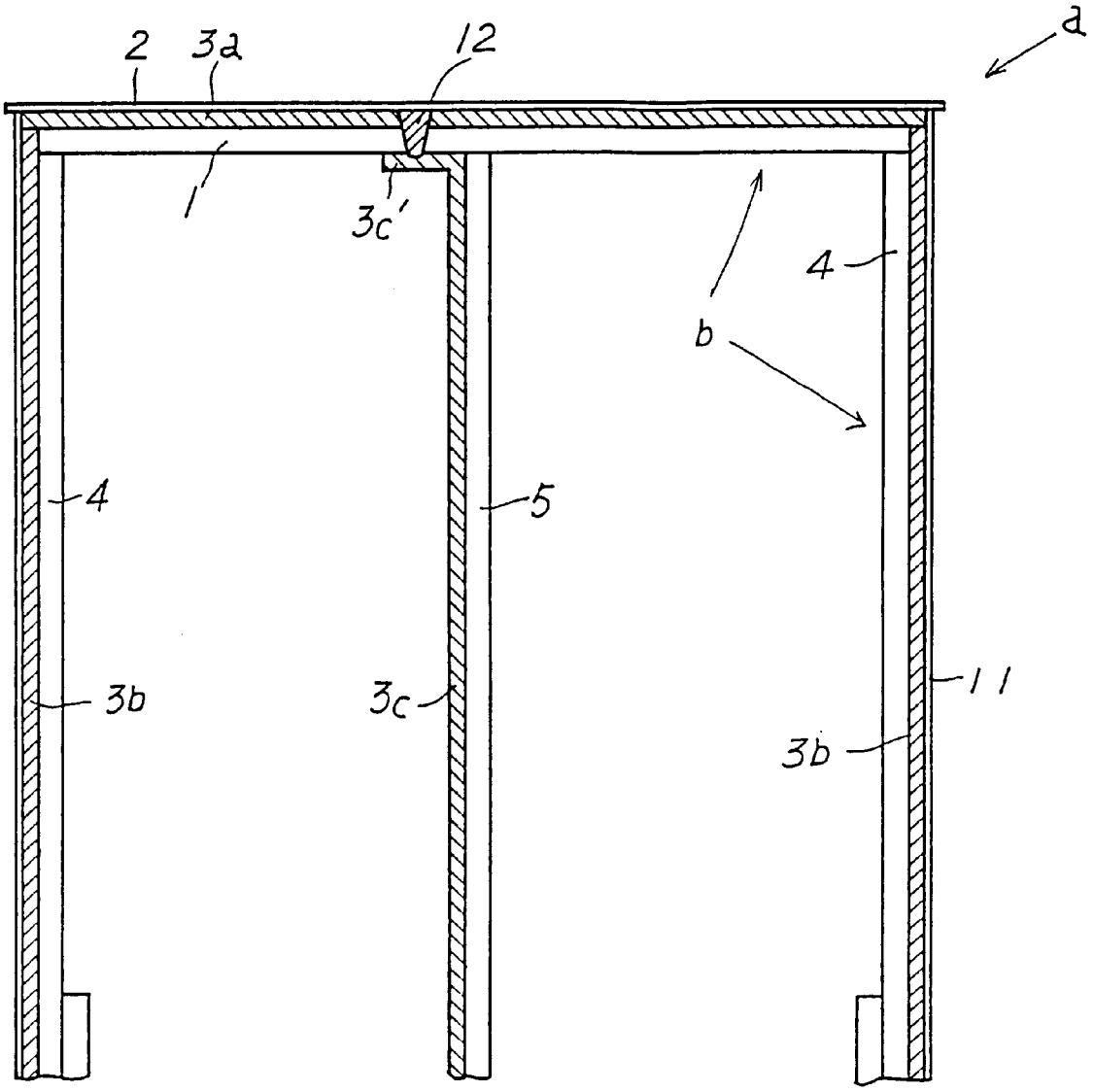
FIG. 4 is a longitudinal sectional view of a type of drum having an intermediate reinforcement plate provided with the intermediate copper system plate in an intermediate portion, in which hatching for parts other than the copper system plates is omitted.
Figure 5:
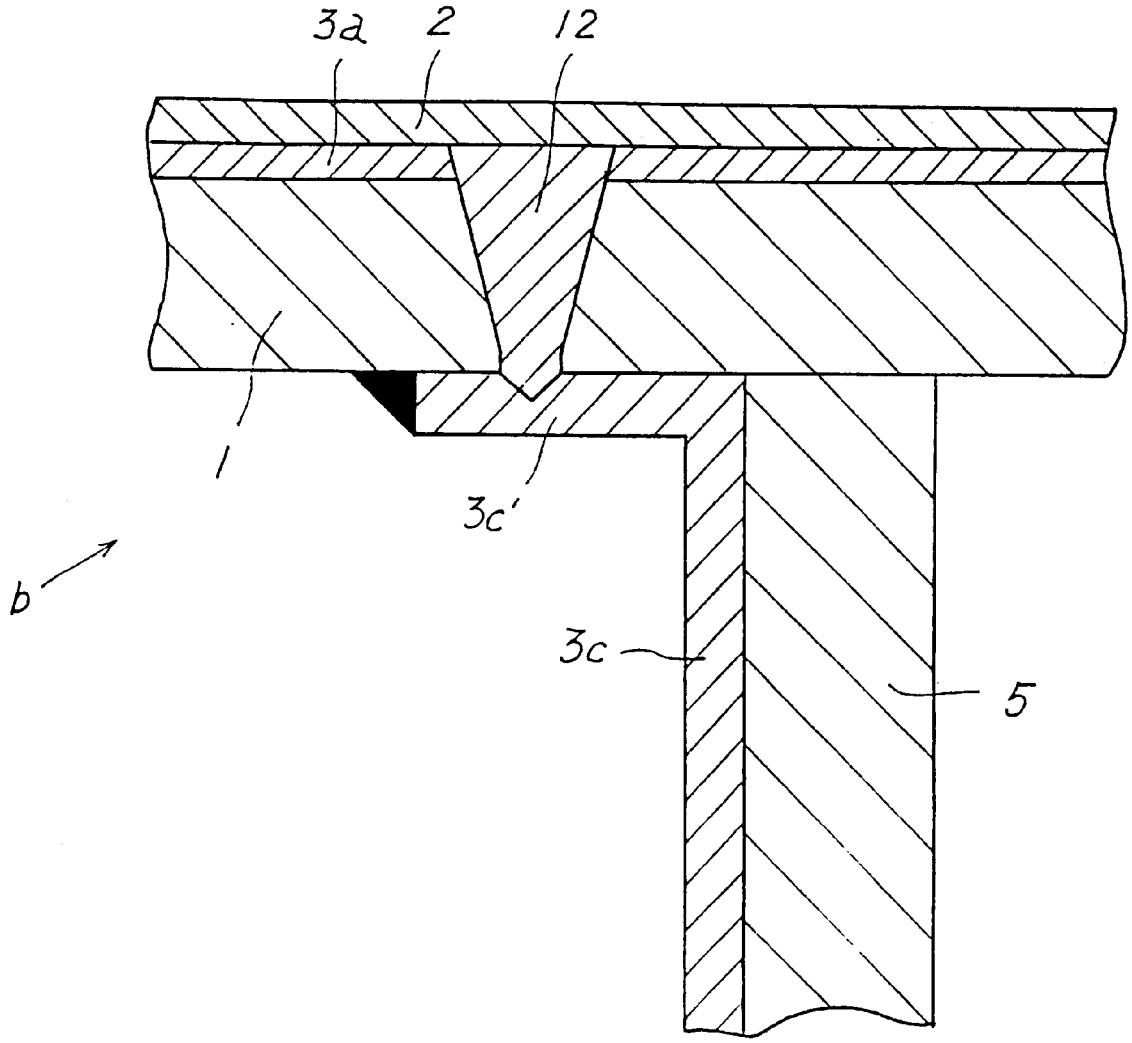
FIG. 5 is a cross-sectional view showing a linear weld portion shown in FIG. 4

FIG. 4 is a view showing an embodiment in which the intermediate copper system plate 3*c* is provided on the intermediate reinforcement plate 5, and outer edge portions of the intermediate copper system plate 3*c* are formed integrally with the circumferential copper system plate 3*a* under the conductive condition. As shown in an enlarged view of FIG. 5, a horizontal ring-shaped flange 3*c*' is formed integrally with the outer edge of the intermediate copper system plate 3*c*. The flange 3*c*' and the circumferential copper system plate 3*a* are formed integrally with each other through a line welded portion 12.

The copper system plate is superior in heat conductivity to the titanium plate 2 as follows:

copper: 0.94 (20° C.·cal/cm·s·° C.)

titanium: 0.037 (20° C.·cal/cm·s·° C.)

Accordingly, the above-described provision of the circumferential copper system plate 3*a*, the side copper system plates 3*b* and the intermediate copper system plate 3*c* leads to the improvement in heat conductivity and also exhibits the advantage of preventing the local hot zone. It is thus possible to perform the manufacture of foil having a constant thickness with a smooth surface.

One example of a dimension of the electrodeposition drum is given as follows:

| | |
|---|---|
| electrodeposition drum | Ø2,300 mm in diameter |
| electrodeposition drum | 1,200 mm in width |
| drum outer circumferential plates 1 made of stainless steel or soft iron | 22 mm in thickness |
| titanium plate 2 | 5 mm in thickness |
| circumferential copper system plate 3a such as a copper plate or a copper alloy plate | 4 mm in thickness |
| side copper system plates 3b such as a copper plate or a copper alloy plate | 5 mm in thickness |
| intermediate copper system plate 3c such as a copper plate or a copper alloy plate | 7 mm in thickness |
| side wall plates 4 made of stainless steel or soft iron | 22 mm in thickness |
| intermediate reinforcement plate 5 made of stainless steel or soft iron | 22 mm in thickness |
| large diameter portion of copper sleeve 3d provided around rotary shaft 9 | 60 mm in thickness |
| side titanium plate 11 | 4 mm in thickness |

According to a first aspect of the present invention, the copper system plate, which is formed from materials such as copper, copper alloy plate or brass which have superior linear expansion coefficients, is adhered to the inner circumferential surface of the titanium plate. The contactability between the titanium plate and the copper system plate is enhanced. Since the copper system plate is far superior to the titanium plate in conductivity, the insufficiency of conductivity of the titanium plate is compensated for. According to this synergetic effect, the reduction of the insulation preventing effect caused by a skin generation of the surface corrosion layer or the surface oxidized layer is compensated for. The copper foil that is to be continuously produced is manufactured into foil having a constant thickness with a uniform and smooth surface over the full range. In addition, a copper foil that has an excellent quality, and without any generation of electric resistive heat, is produced on the surface of the titanium plate.

Also, according to a second aspect of the present invention, the side copper system plates such as copper plates or copper alloy plates are provided on the outer surfaces of the right and left side plates of the inner drum, and the side copper system plates and the circumferential copper system plate are provided close to or integrally with each other under a conductive condition. The electric supply to the circumferential copper system plate by the side copper system plates is increased to further enhance the advantages of the first aspect.

Also, according to a third aspect of the present invention, the intermediate copper system plate is provided on the intermediate reinforcement plate of the inner drum, and the intermediate copper system plate and the circumferential copper system plate are provided close to or integrally with each other under a conductive condition. As a result, the electric supply to the titanium plate is increased to thereby further enhance the advantages of the first and second aspects of the present invention.

Various details of the invention may be changed without departing from its spirit and scope. Furthermore, the foregoing description of the embodiments according to the present invention is provided for the purpose of illustration only, and not for the purpose of limiting the invention as defined by the appended claims and their equivalents.

What is claimed is:

1. A titanium electrodeposition drum in which a titanium plate is disposed over an outer circumferential surface of an outer circumferential plate of an inner drum, comprising:

a circumferential copper system plate which is interposed between the outer circumferential surface of the outer circumferential plate of the inner drum and an inner circumferential surface of the titanium plate and wherein opposite surfaces of said circumferential copper system plate are in intimate contact with the inner circumferential surface of the titanium plate and the outer circumferential surface of the outer circumferential plate of the inner drum, respectively.

2. The titanium electrodeposition drum according to claim 1, further comprising side copper system plates disposed over outer surfaces of right and left side wall plates of the inner drum, wherein said side copper system plates and said circumferential copper system plate are provided close to or integrally with each other.

3. The titanium electrodeposition drum according to claims 1 or 2, further comprising an intermediate copper system plate disposed over an intermediate reinforcement plate of the inner drum, and the intermediate copper system plate and the circumferential copper system plate are provided close to or integrally with each other.

4. The titanium electrodeposition drum of claim 3, wherein said intermediate copper system plate is made of copper or a copper alloy.

5. The titanium electrodeposition drum of claim 4, wherein said copper alloy includes brass.

6. The titanium electrodeposition drum of claim 3, wherein said intermediate reinforcement plate is made of stainless steel or soft iron.

7. The titanium electrodeposition drum of claim 3, further comprising a welded portion connecting said circumferential copper system plate and a flange of said intermediate copper system plate, said welded portion extending through the outer circumferential plate of the inner drum.

8. The titanium electrodeposition drum of claim 2, wherein said side copper system plates are made of copper or a copper alloy.

9. The titanium electrodeposition drum of claim 8, wherein said copper alloy includes brass.

10. The titanium electrodeposition drum of claim 2, further comprising a welded portion connecting at least one of said side copper system plates with a continuous outer circumferential plate disposed over said side copper system plates.

11. The titanium electrodeposition drum of claim 2, wherein said side wall plates are made of stainless steel or soft iron.

12. The titanium electrodeposition drum of claim 1, wherein said circumferential copper system plate is made of copper or a copper alloy.

13. The titanium electrodeposition drum of claim 12, wherein said copper alloy includes brass.

14. The titanium electrodeposition drum of claim 1, wherein said outer circumferential plate is made of stainless steel or soft iron.

* * * * *

UNITED STATES PATENT AND TRADEMARK OFFICE

CERTIFICATE OF CORRECTION

PATENT NO. : 6,036,826
DATED : March 14, 2000
INVENTOR(S) : Katsuya KAWACHI and Mitsuo KIHARA It is certified that error appears in the above-identified patent and that said Letters Patent is hereby corrected as shown below:

Item [73] Assignee, change "Nitto Stainless Steel Kozai Co., Ltd." to "Nippon Stainless Steel Kozai Co., Ltd.";

In the abstract, line 1, "n" should be --in--;

line 3, "b" should be -- "b"--; and line 7, "b" should be -- "b" --.

Column 1, line 4, "titaniumi" should be --titanium --; and line 26, "kept well," should be --good,--.

Column 3, line 13, "a" (second occurrence) should be --an--;

lines 16, 19, 25 and 31, "b" should be -- "b"--; and line 35, "A" should be -- "A" --.

Signed and Sealed this

Fifth Day of June, 2001

Nicholas P. Godici

NICHOLAS P. GODICI

*Acting Director of the United States Patent and Trademark Office*

*Attest:*

*Attesting Officer*